US009345634B2

(12) United States Patent
Ju et al.

(10) Patent No.: US 9,345,634 B2
(45) Date of Patent: May 24, 2016

(54) HAND REHABILITATION DEVICE

(75) Inventors: Ming-Shaung Ju, Tainan (TW); Chou-Ching Lin, Tainan (TW); Meng-Dar Shieh, Tainan (TW); Shu-Min Chen, Tainan (TW); Yu-Ching Lin, Tainan (TW); Yung-Nien Sun, Tainan (TW); Pin-Cheng Kung, Tainan (TW); Chia-Chun Hung, Tainan (TW); Yi-Ting Lee, Tainan (TW)

(73) Assignee: NATIONAL CHENG KUNG UNIVERSITY, Tainan (TW)

( * ) Notice: Subject to any disclaimer, the term of this patent is extended or adjusted under 35 U.S.C. 154(b) by 918 days.

(21) Appl. No.: 13/620,406

(22) Filed: Sep. 14, 2012

(65) Prior Publication Data

US 2013/0012362 A1 Jan. 10, 2013

(30) Foreign Application Priority Data

Sep. 27, 2011 (TW) ..... 100134848

(51) Int. Cl.
*A61H 1/00* (2006.01)
*A61H 1/02* (2006.01)

(52) U.S. Cl.
CPC ..... *A61H 1/0285* (2013.01); *A61H 1/0288* (2013.01); *A61H 2201/0157* (2013.01); *A61H 2201/123* (2013.01); *A61H 2201/1246* (2013.01); *A61H 2201/1638* (2013.01); *A61H 2201/1676* (2013.01)

(58) Field of Classification Search
CPC ..... A61H 1/0285; A61H 1/0288; A61H 2201/1635; A61H 2201/1638
See application file for complete search history.

(56) References Cited

U.S. PATENT DOCUMENTS

| | | | | | |
|---|---|---|---|---|---|
| 4,730,827 | A | | 3/1988 | Williams | |
| 4,988,091 | A | | 1/1991 | Schaefer | |
| 5,170,777 | A | * | 12/1992 | Reddy | A61H 1/0274 482/44 |
| 5,380,259 | A | * | 1/1995 | Robertson | A63B 21/023 482/123 |
| 5,695,431 | A | | 12/1997 | Bond et al. | |
| 5,738,636 | A | * | 4/1998 | Saringer | A61H 1/0285 601/29 |
| 6,149,612 | A | * | 11/2000 | Schnapp | A61H 1/0285 482/44 |
| 6,454,681 | B1 | | 9/2002 | Brassil et al. | |
| 6,733,421 | B1 | | 5/2004 | Jones | |
| 6,743,187 | B2 | * | 6/2004 | Solomon | A61H 1/02 600/587 |
| 7,618,381 | B2 | | 11/2009 | Krebs et al. | |
| 7,857,778 | B2 | * | 12/2010 | de Muinck | A61H 1/0274 482/92 |
| 2010/0042023 | A1 | * | 2/2010 | Park | A61H 1/0288 601/40 |
| 2012/0238920 | A1 | * | 9/2012 | Schnapp | A61H 1/0285 601/5 |

FOREIGN PATENT DOCUMENTS

| | | | |
|---|---|---|---|
| CN | 2688278 | Y | 3/2005 |
| JP | H 10-165464 | A | 6/1998 |
| TW | M248435 | | 11/2004 |
| TW | I345969 | | 8/2011 |

* cited by examiner

*Primary Examiner* — Justine Yu
*Assistant Examiner* — Kathrynn Lyddane
(74) *Attorney, Agent, or Firm* — CKC & Partners Co., Ltd.

(57) ABSTRACT

A hand rehabilitation device includes a base having an arm support. A first actuator is mounted to the base and includes a first output end. A second actuator is connected to the first output end of the first actuator and includes a second output end. A handle is connected to the second output end. One of the first and second output ends rotates about an axis. The other of the first and second output ends reciprocates in a direction.

15 Claims, 7 Drawing Sheets

HAND REHABILITATION DEVICE

BACKGROUND OF THE INVENTION

1. Field of the Invention

The present invention relates to a hand rehabilitation device and, more particularly, to a hand rehabilitation device for rehabilitating fingers and wrists.

2. Description of the Related Art

FIG. 1 shows a conventional hand rehabilitation device 9 including a rehabilitation glove 91, a body 92, a controller 93, and a string 94. The rehabilitation glove 91 includes an air bag 911 and a glove 912. The body 92 is a support device and receives a pneumatic cylinder 921 including a push rod 922. A tractor 923 is mounted to a front end of the push rod 922. An arm of a user can rest on a top face of the body 92. The controller 93 is an inflation device for controlling intake and discharge of air in the air bag 911 and the pneumatic cylinder 921. An end of the string 94 is connected to a front end of the air bag 911. The other end of the string 94 extends around the tractor 923 and can be moved by the push rod 922 of the pneumatic cylinder 921.

After attaching the rehabilitation glove 91 to the body 92, a wrist and fingers of a user hang out of the body 92. When the air bag 911 is inflated, the push rod 922 of the pneumatic cylinder 921 is in a retracted position, allowing the fingers and the wrist to extend for rehabilitation. On the other hand, when the air bag 911 is deflated, the push rod 922 of the pneumatic cylinder 921 is in an extended position, the string 94 pulls the rehabilitation glove 91, causing rehabilitative flexion of the fingers and the wrist. An example of such a hand rehabilitation device is disclosed in Taiwan Utility Model M248435.

However, the flexion and extension of the wrist and each finger joint of the user can not be precisely controlled by changing the inflation extent of the air bag 911, obtaining limited rehabilitation effect. Furthermore, during repeated rehabilitation movements of the user, the inflation or deflation of the air bag 911 requires a certain period of time, such that only few rehabilitation movements are done during a long period of time, reducing the rehabilitation effect and adversely affecting the rehabilitation will of the user. Further, movement of the controller 93 causes noise and vibration, adversely affecting using comfort of the hand rehabilitation device 9. Further, the hand rehabilitation device 9 includes many wires that require time-consuming arrangement before and after use. Further, these wires may entangle the body of the user and causes undesired movement of the hand rehabilitation device 9 or injury of people, failing to provide use safety and use convenience.

SUMMARY OF THE INVENTION

An objective of the present invention is to provide a hand rehabilitation device that can precisely control the flexion and extension of the wrist and each finger joint to increase the rehabilitation effect.

Another objective of the present invention is to provide a hand rehabilitation device including a handle for manual operation by a user to rotate or telescope, providing enhanced rehabilitation efficiency.

A further objective of the present invention is to provide a hand rehabilitation device that store wires to provide a neat appearance while providing enhanced use safety and use convenience.

The present invention fulfills the above objectives by providing a hand rehabilitation device including a base having an arm support. A first actuator is mounted to the base and includes a first output end. A second actuator is connected to the first output end of the first actuator and includes a second output end. A handle is connected to the second output end. One of the first and second output ends rotates about an axis. The other of the first and second output ends reciprocates in a direction.

The first output end can be a shaft rotatable about the axis.

The second output end can be a telescopic component reciprocating in the direction.

The direction is preferably perpendicular to the axis about which the first output end of the first actuator rotates.

The handle can include an extension and a handgrip. The extension includes an end connected to the second output end. The extension extends towards a location adjacent to the arm support. The handgrip is rotatably mounted to the other end of the extension.

Preferably, the handgrip of the handle includes a longitudinal axis perpendicular to the arm support.

Preferably, the handgrip of the handle includes a finger retaining member.

Preferably, with the second actuator is received in a housing. An auxiliary positioning member and a baffle plate are provided on a face of the housing.

Preferably, the housing includes an opening. The second output end extends out of the housing through the opening and is connected to the extension of the handle.

Preferably, the auxiliary positioning member is parallel to a longitudinal axis of the handgrip.

Preferably, a forearm positioning member is mounted to the arm support and aligned with the handgrip of the handle.

Preferably, the arm support is inclined relative to the base.

Preferably, the second actuator is mounted to an engagement member. The first output end of the first actuator extends through the engagement member and is connected to the arm support.

The first actuator can be a motor.

The second actuator can be an electric cylinder, hydraulic cylinder, pneumatic cylinder, or rack gears.

Preferably, an elbow support is mounted to the base and includes first and second rods and a support. The first rod is mounted to the base. An end of the second rod is pivotably mounted to the first rod. The support is pivotably mounted to the other end of the second rod. The support is adapted to support an elbow of a user of the hand rehabilitation device.

Preferably, the hand rehabilitation device further includes a fixing device having first and second fixing boards, with a holding space defined between the first and second fixing boards. The first fixing board includes at least one sliding groove. The base includes a bottom having a plurality of fixing holes facing the at least one sliding groove. The second fixing board includes a plurality of adjusting members.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 1:
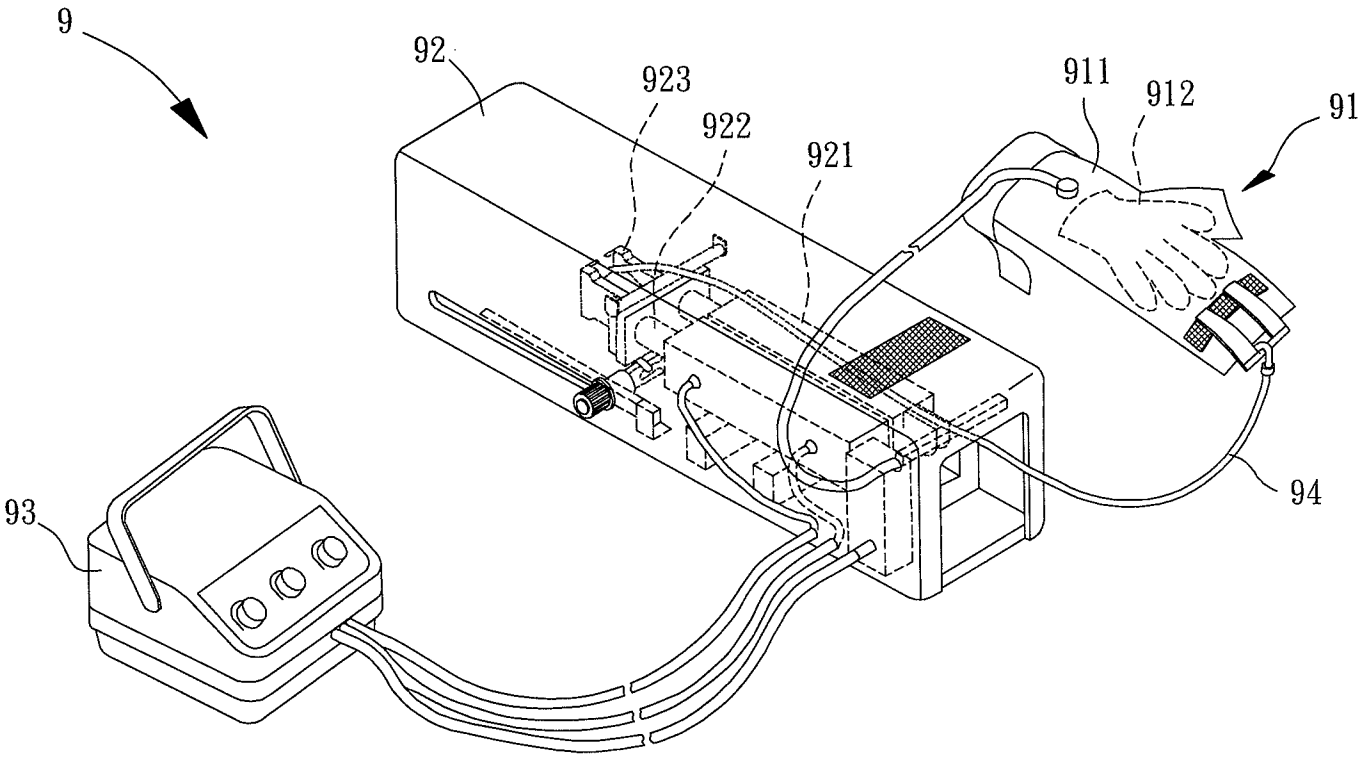
FIG. 1 PRIOR ART
FIG. 1 shows a perspective view of a conventional hand rehabilitation device.
Figure 2:
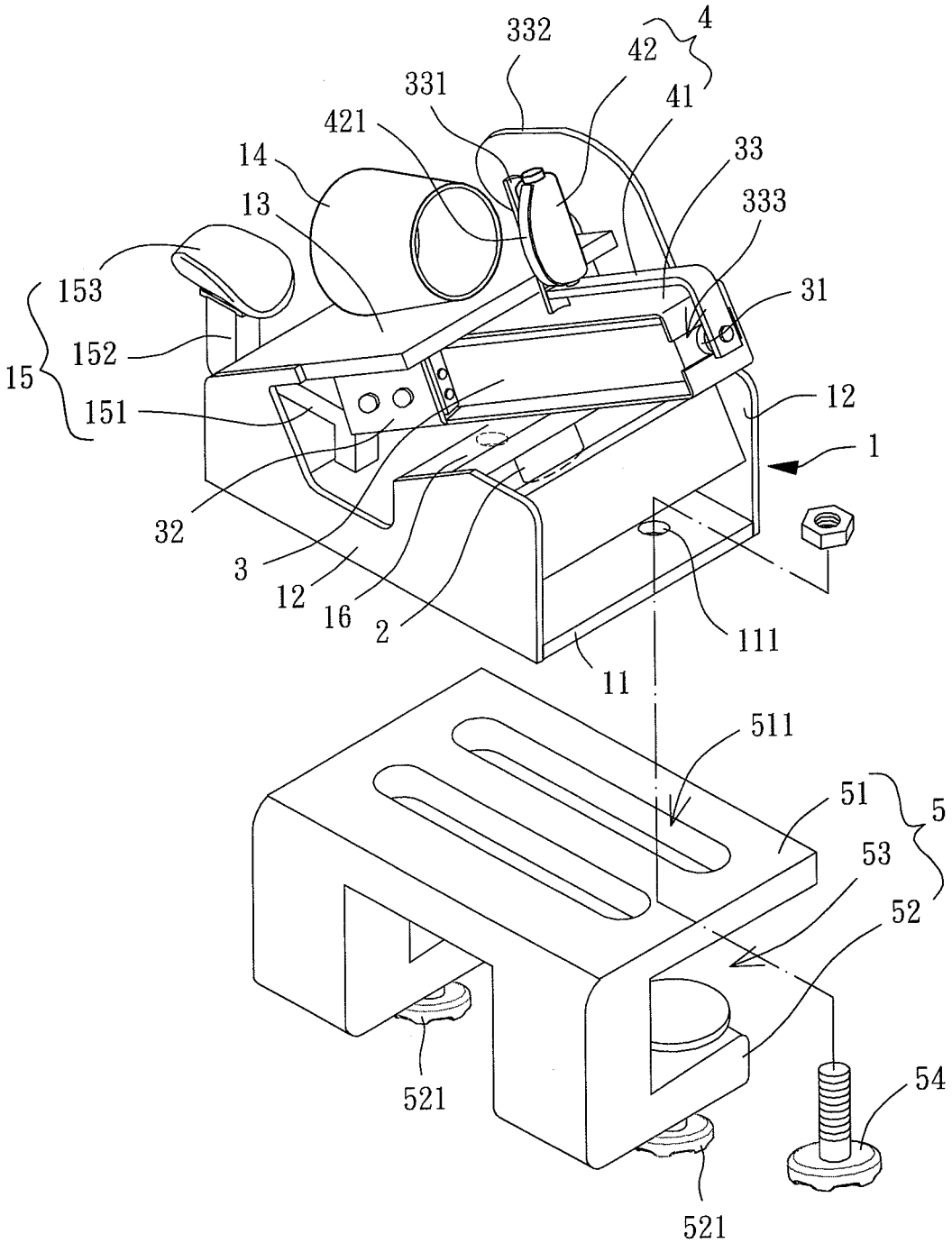
FIG. 2 shows an exploded, perspective view of a hand rehabilitation device according to the present invention.
Figure 3:
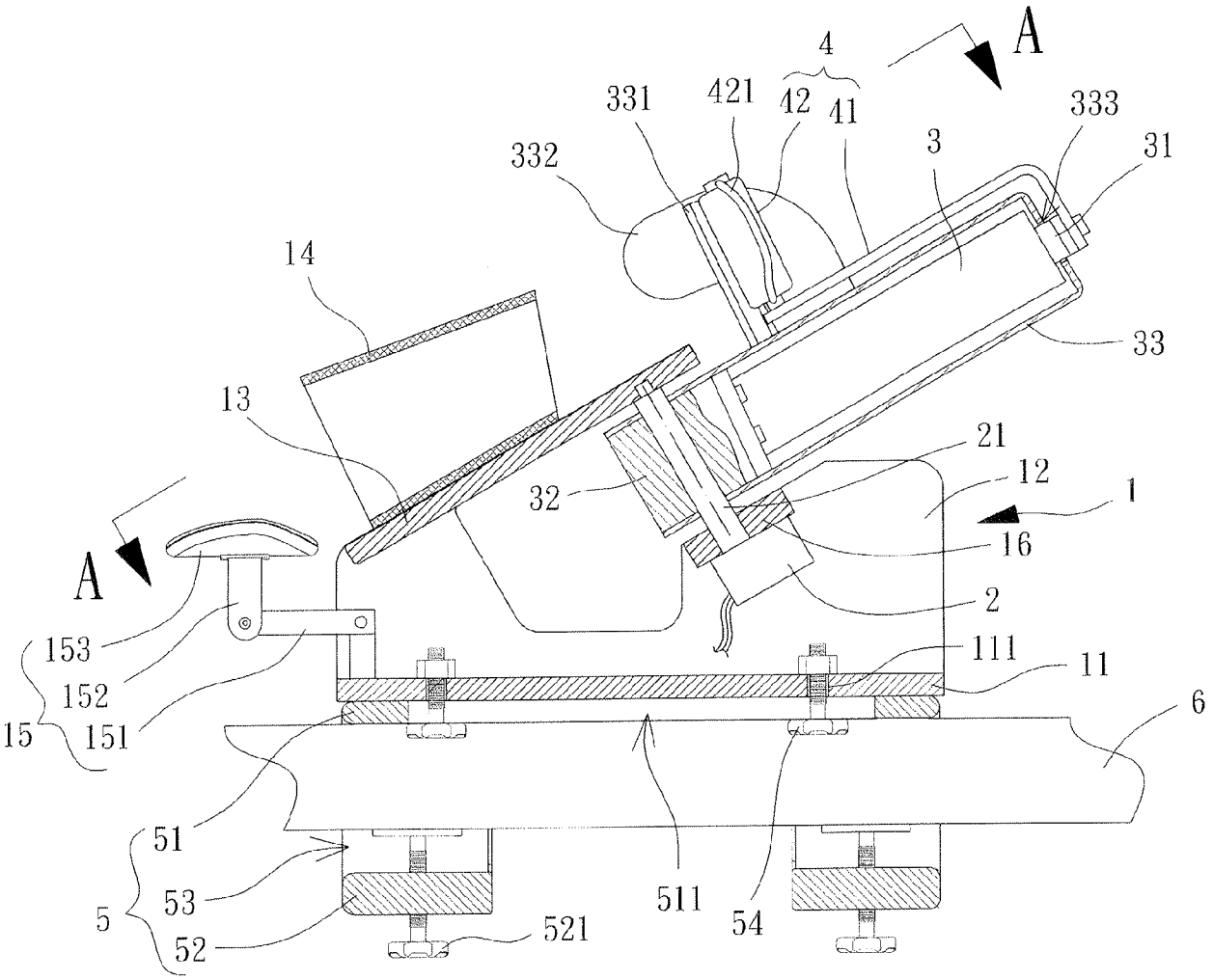
FIG. 3 shows a cross sectional view of the hand rehabilitation device according to the present invention.

FIGS. 2 and 3 show an exploded perspective view and a perspective view of an embodiment of a hand rehabilitation device according to the present invention. In this embodiment, the hand rehabilitation device includes a base 1, a first actuator 2, and a second actuator 3. The first and second actuators 2 and 3 are mounted to the base 1 for moving fingers and a wrist of a user for rehabilitation purposes.

The base 1 is a frame to which the components of the hand rehabilitation device are attached. In this embodiment, the base 1 includes a bottom board 11 and a plurality of side boards 12 mounted to a periphery of the bottom board 11. The bottom board 11 may include a plurality of fixing holes 111.

The base 1 further includes an arm support 13 for supporting an arm of a user. In this embodiment, the arm support 13 is mounted to a top of the base 1 and is preferably inclined relative to the base 1 for ergonomics. Thus, the user can comfortably lay an arm on the arm support 13, providing enhanced comfort while using the hand rehabilitation device. Even a user in a sickbed can directly use the hand rehabilitation device.

The bottom board 11, the side boards 12, and the arm support 13 can be separated from each other and can be fixed to each other by fasteners or glue. Alternatively, the bottom board 11, the side boards 12, and the arm support 13 can be integrally formed with each other to form the base 1. The present invention is not limited in this regard.

A forearm positioning member 14 can be provided on an upper face of the arm support 13. The arm of the user can extend through and be positioned by the forearm positioning member 14, avoiding adverse effect to rehabilitation due to significant displacement of the forearm of the user during rehabilitation. The forearm positioning member 14 can be of different forms. As an example, the forearm positioning member 14 can be a socket with a predetermined outline or straps with hook and loop fasteners. The present invention is not limited in this regard.

An elbow support 15 can be selectively mounted to the base 1 in a position adjacent to an elbow of the user, with the elbow support 15 extending outward from the base 1. In this embodiment, the elbow support 15 includes a first rod 151, a second rod 152, and a support 153. The first rod 151 is mounted to the base 1. An end of the second rod 152 is pivotably mounted to the first rod 151, allowing the second rod 152 to pivot relative to the first rod 151 through a predetermined angle. The support 153 is pivotably mounted to the other end of the second rod 152 and is pivotable relative to the second rod 152 through a predetermined angle. The elbow of the user may rest on the support 153, providing stability and comfort for the user while the forearm rests on the base 1. By adjusting the relative angular position between the first and second rods 151 and 152 and adjusting the relative angular position between the second rod 152 and the support 153, a height of the elbow support 15 relative to the base 1 can be adjusted. Thus, every user can rest the forearm in a comfortable angle while operating the hand rehabilitation device.

The first actuator 2 is mounted to the base 1 and includes a first output end 21. The second actuator 3 is connected to the first output end 21 of the first actuator 2 and includes a second output end 31. One of the first and second output ends 21 and 31 rotates about an axis. The other of the first and second output ends 21 and 31 reciprocates in a direction perpendicular to the axis. A handle 4 is connected to the second output end 31 of the second actuator 3 and faces the arm support 13. The handle 4 can be actuated by the second actuator 3. Furthermore, the second actuator 3 and the handle 4 can be synchronously actuated by the first actuator 2.

In this embodiment, the first actuator 2 is a rotational actuator (such as a motor), with the first output end 21 being a shaft of the rotational actuator rotatable about the axis. The second actuator 3 is a linear actuator (such as en electric cylinder, hydraulic cylinder, pneumatic cylinder, or rack gears), with the second output end 31 being a telescopic component of the linear actuator moving in the direction perpendicular to the axis. However, the first actuator 2 can be a rotational actuator, and the second actuator 3 can be a linear actuator.

A positioning board 16 can be mounted between two opposite side boards 12 of the base 1 for mounting the first actuator 2. The second actuator 3 can be mounted to an engagement member 32. The first output end 21 of the first actuator 2 extends through the engagement member 32 and is coupled to the base 1. In this embodiment, the first output end 21 of the first actuator 2 extends through the positioning board 16 and the engagement member 32 and is coupled to a lower face of the arm support 13. Thus, when the first actuator 2 operates, the engagement member 32 and the second actuator 3 sway relative to the arm support 13 due to rotation of the first output end 21 in either of two opposite rotating directions.

In this embodiment, the second actuator 3 is mounted in a housing 33. An auxiliary positioning member 331 and a baffle plate 332 are mounted to a face of the housing 33. A thumb of the user can abut against the auxiliary positioning member 331 to position the palm of the user. Back of the hand of the user abuts against the baffle plate 332. The first output end 21 of the first actuator 2 also extends through the housing 33. The housing 33 includes an opening 333. The second output end 31 of the second actuator 3 extends out of the housing 33 through the opening 333 and is connected to the handle 4. Thus, the handle 4 reciprocates in the direction perpendicular to the axis when the second output end 31 of the second actuator 3 telescopes in the direction.

The handle 4 includes an extension 41 and a handgrip 42. An end of the extension 41 is connected to an end of the second output end 31 outside of the opening 333 and extends toward a location adjacent to the arm support 13. The handgrip 42 is rotatably connected to the other end of the extension 41. The handgrip 42 is aligned with the forearm positioning member 14. Preferably, the handgrip 42 includes a longitudinal axis perpendicular to the arm support 13 and parallel to the auxiliary positioning member 331. When the forearm of the user is positioned to the forearm positioning member 14, the palm of the user is in a location allowing easy gripping of the handgrip 42.

The handgrip 42 can further include a finger retaining member 421 allowing the fingers of the user to be retained to the handgrip 42. This assists in a user losing holding function to retain his or her fingers to the handgrip 42. The finger retaining member 421 can be straps with hook and loop fasteners, elastic straps, or length-adjustable holding straps. Furthermore, the user may wear a magnetic glove such that the fingers of the user can be retained to the handgrip 42 by magnetic attraction while the fingers of the user are holding the handgrip 42 of the handle 4. However, the present invention is not limited to this arrangement.

To increase use convenience of the hand rehabilitation device, an attachment device 5 can be provided to attach the hand rehabilitation device to a sickbed 6, allowing a user lying in the sickbed 6 to directly use the hand rehabilitation device. Thus, the user can rehabilitate during the golden rehabilitation period without getting out of the sickbed 6, significantly enhancing the rehabilitation effect. In this embodiment, the attachment device 5 includes first and second fixing boards 51 and 52 aligned with each other and spaced from each other by a predetermined height to define a holding space 53. The first fixing board 51 includes at least one sliding groove 511. The second fixing board 52 includes a plurality of adjusting members 521. The holding space 53 allows the attachment device 5 to be mounted to an edge of the sickbed 6. In assembly, the bottom board 11 of the base 1 abuts the first fixing board 51. A plurality of fasteners 54 is extended through the sliding groove 511 and the fixing holes 111 of the bottom board 11, engaging the base 1 with the attachment device 5. The relative position between the base 1 and the attachment device 5 can be adjusted through the sliding groove 511. The adjusting members 521 of the second fixing board 52 can be adjusted to tightly pressing tops of the adjusting members 521 against a bottom face of the edge of the sickbed 6. Thus, the attachment device 5 is securely attached to the edge of the sickbed 6 by the adjusting members 521.

Figure 4:
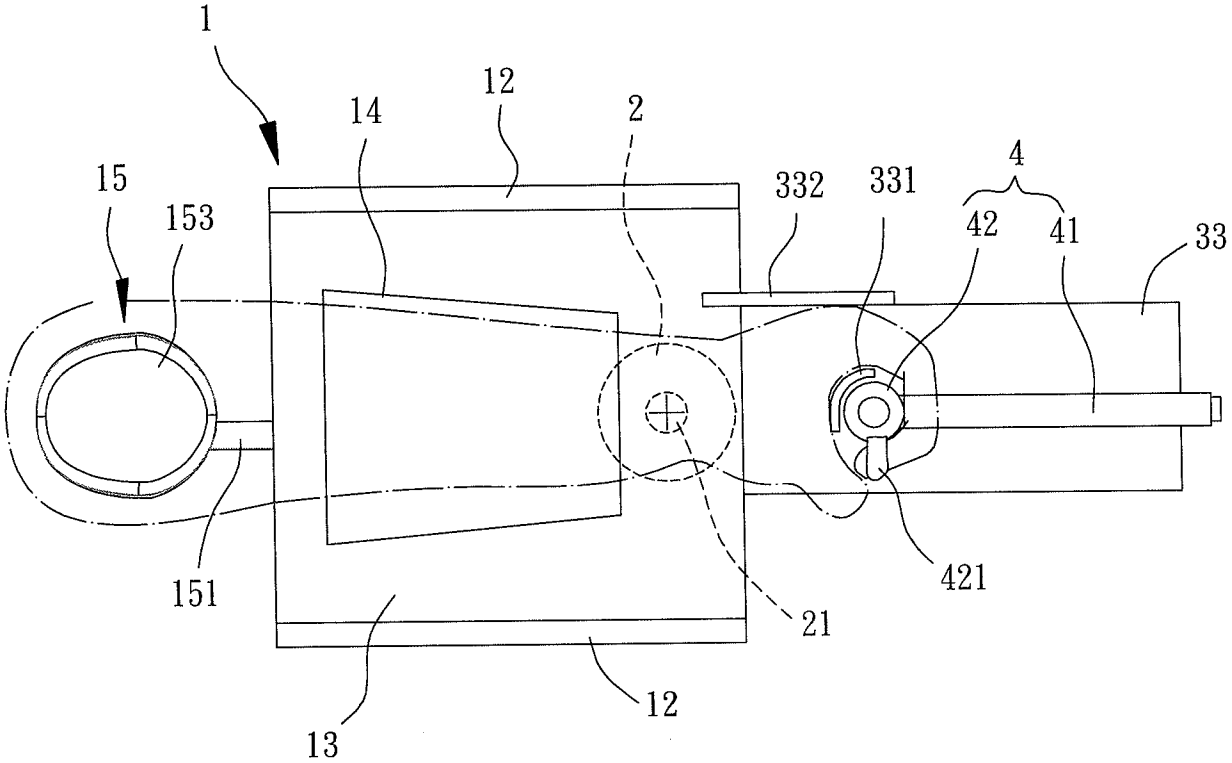
FIG. 4 shows a cross sectional view taken along section line A-A of FIG. 3, with a hand of a user in a position ready for rehabilitation.

With reference to FIG. 4, in use of the hand rehabilitation device, a user places the elbow on the support 153 of the elbow support 15. The forearm of the user is positioned by the forearm positioning member 14. The palm of the user holds the handgrip 42. The fingers are retained to the handgrip 42 by the finger retaining member 421. The thumb and the back of the hand of the user respectively abut the auxiliary positioning member 331 and the baffle plate 332.

Figure 5:
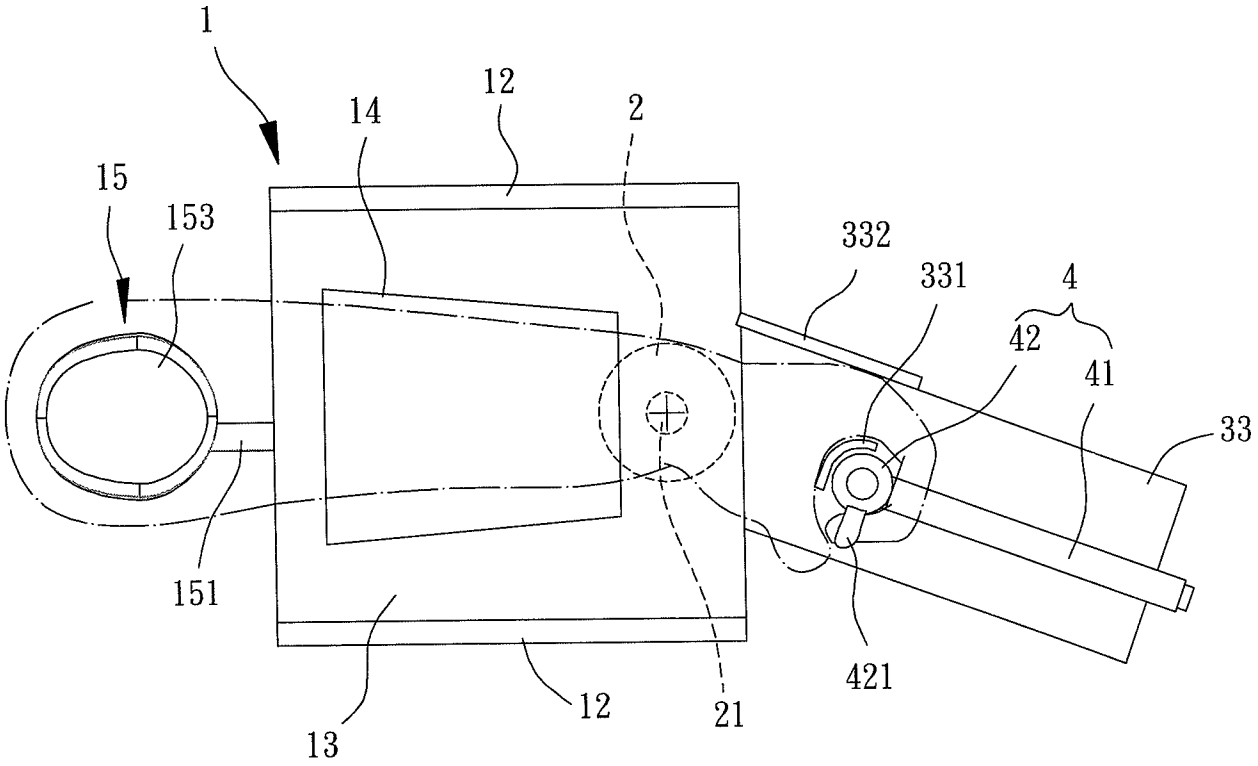
FIG. 5 shows a view similar to FIG. 4, illustrating rehabilitation of the wrist of the hand.

With reference to FIG. 5, after the hand of the user is positioned, the first output end 21 of the first actuator 2 is driven to actuate the housing 33 to rotate about the axis. The palm of the user retained to the handgrip 42 of the handle 4 pivots relative to the forearm, repeatedly flexing the wrist inwards and outwards. Thus, the hand rehabilitation device can cause repeated flexion and extension of the wrist to rehabilitate the wrist.

Figure 6:
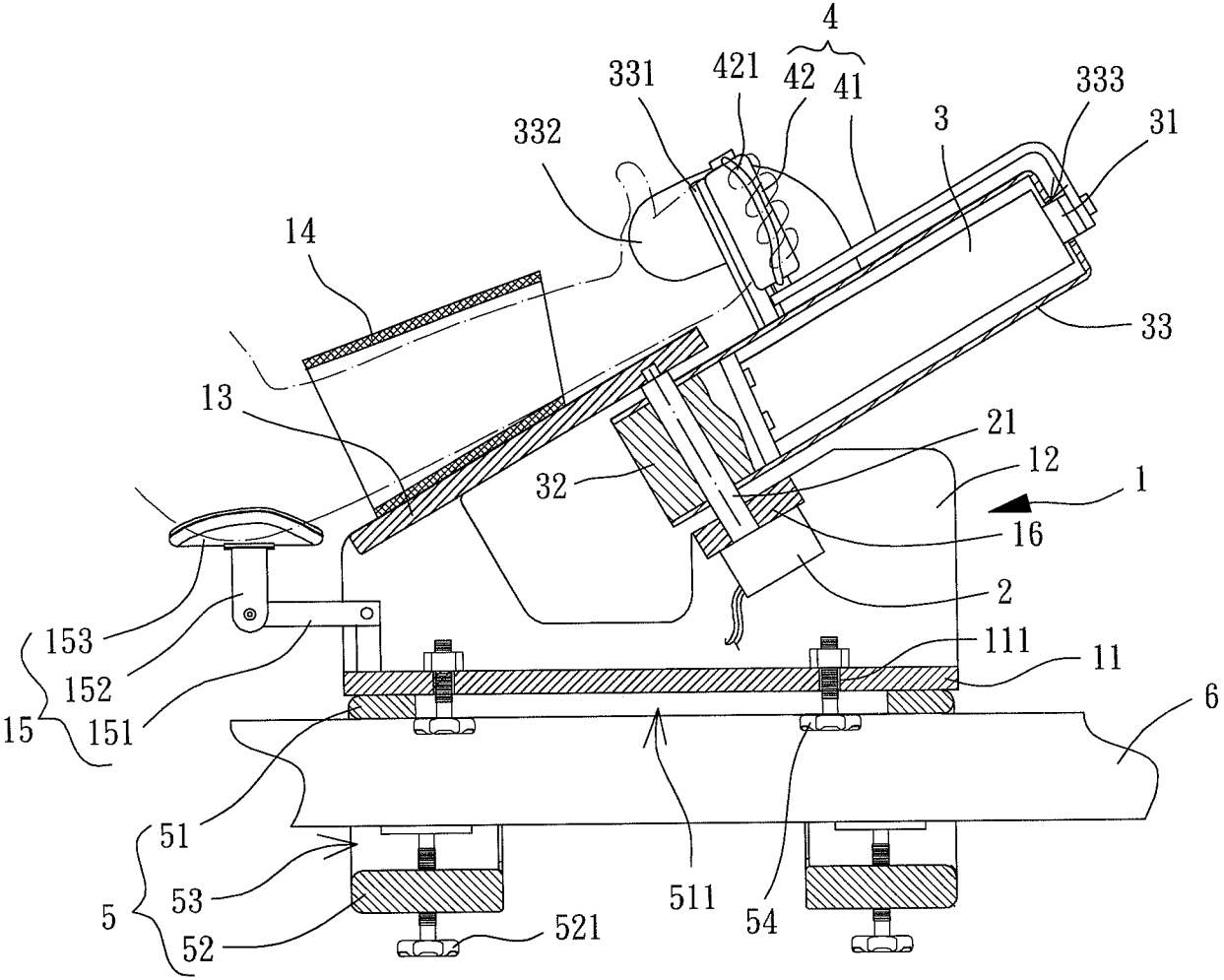
FIGS. 6 and 7 are cross sectional views similar to FIG. 3, illustrating rehabilitation of fingers.
Figure 7:
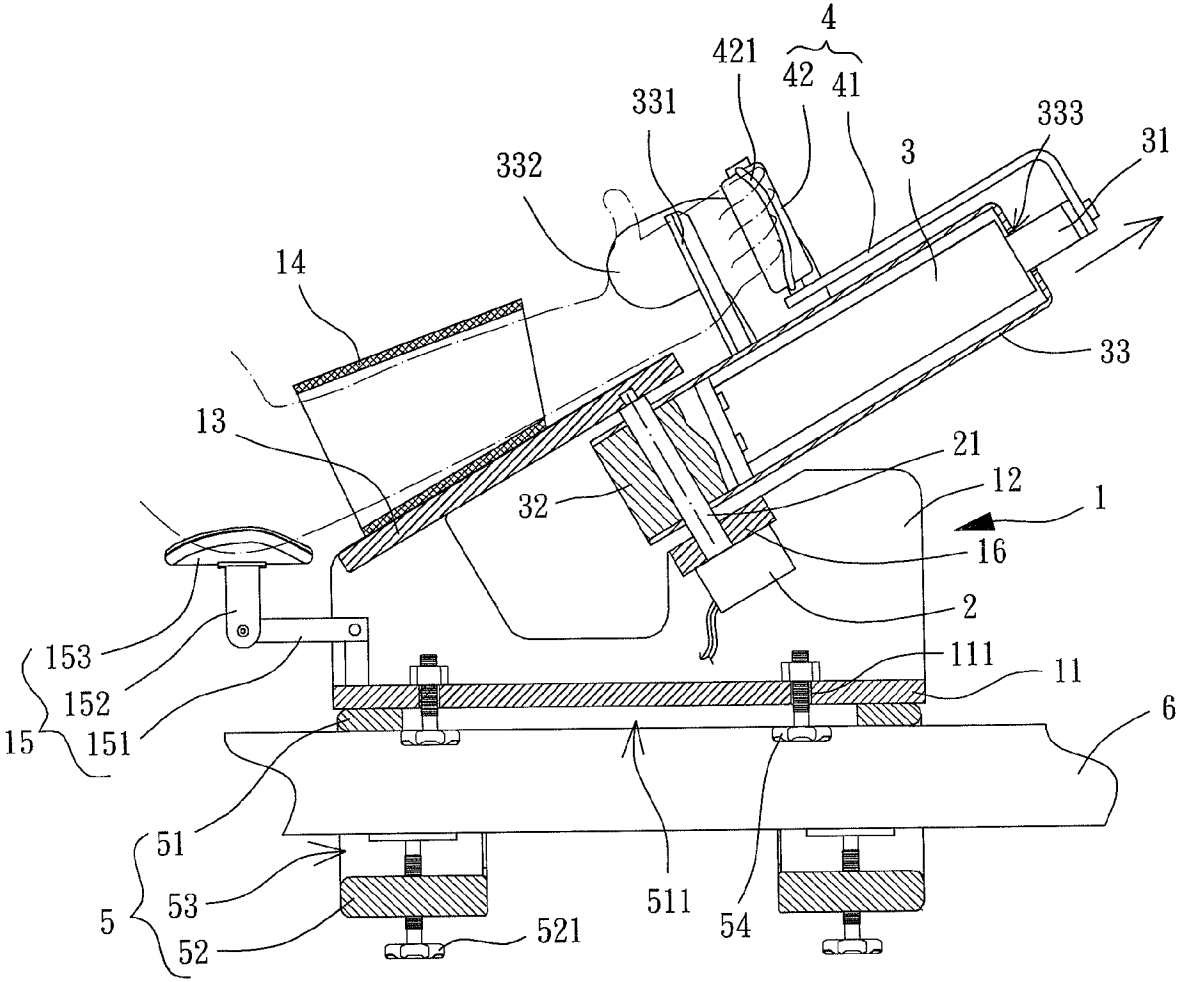

With reference to FIGS. 6 and 7, when it is desired to use the hand rehabilitation device to rehabilitate fingers, the second output end 31 of the second actuator 3 is driven to actuate the extension 41 of the handle 4 to move in the direction perpendicular to the axis. When the extension 41 of the handle 4 is in a first position, the fingers flex and hold the handgrip 42 of the handle 4, as shown in FIG. 6. When the second output end 31 gradually extends out of the second actuator 3, the handle 4 is moved synchronously such that the fingers retained to the handgrip 42 gradually extend. When the extension 41 of the handle 4 is in a second position, the fingers of the user extend completely, as shown in FIG. 7. Thus, the hand rehabilitation device can cause repeated flexion and extension of the fingers to rehabilitate the fingers.

A casing (not shown) can be provided to provide an aesthetic appearance for the hand rehabilitation device, such that the first and second actuators 2 and 3 or the fasteners can hardly been seen from the outside. Furthermore, the casing can include various outlines and patterns to provide different styles and quality for decoration purposes. Thus, the hand rehabilitation device is no longer cold equipment, interesting the users and attracting the purchasers. Further, a soft pad can be provided at the area contacting with the hand of the user to provide use comfort during rehabilitation.

In view of the foregoing, the hand rehabilitation device according to the present invention can precisely control the extent of pivotal movement or reciprocating movement of the handle 4 by controlling the first and second actuators 2 and 3, repeatedly moving the hand of the user gripping the handle 4. Thus, the wrist and each finger joint can proceed with predetermined flexion and extension to the desired degree, enhancing the rehabilitation effect.

The hand rehabilitation device according to the present invention can directly control the handle 4 to rotate or reciprocate, such that the hand of the user gripping the handle 4 can be directly driven for rehabilitation movements. The number of rehabilitation movements per unit of time can be increased, effectively increasing the rehabilitation efficiency.

Wires of the first and second actuators 2 and 3 of the hand rehabilitation device according to the present invention can be received in the base 1 to provide a neat appearance for the hand rehabilitation device. Arrangement of the wires before and after use of the hand rehabilitation device is not necessary. Undesired movement of the hand rehabilitation device or injury to people resulting from entanglement with exposed wires is avoided, providing enhanced use safety and use convenience.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A hand rehabilitation device comprising:

a base including an arm support;

a first actuator mounted to the base, wherein the first actuator includes a first output end;

a second actuator connected to the first output end of the first actuator, wherein the second actuator includes a second output end, wherein a handle is connected to the second output end, wherein one of the first and second output ends rotates about an axis, wherein the other one of the first and second output ends reciprocates in a direction, wherein the first and second actuators operate independently; and a housing, wherein the second actuator is received in the housing, wherein an auxiliary positioning member and a baffle plate are provided on a face of the housing, wherein the handle includes an extension and a handgrip, wherein the extension includes an end connected to the second output end, wherein the extension extends towards a location adjacent to the arm support, wherein the handgrip is rotatably mounted to another end of the extension, wherein the handgrip is capable of moving towards or away from the auxiliary positioning member in the direction.

2. The hand rehabilitation device as claimed in claim 1, wherein the first output end is a shaft rotatable about the axis.

3. The hand rehabilitation device as claimed in claim 2, wherein the second output end is a telescopic component reciprocating in the direction.

4. The hand rehabilitation device as claimed in claim 3, wherein the direction is perpendicular to the axis about which the first output end of the first actuator rotates.

5. The hand rehabilitation device as claimed in claim 1, wherein the handgrip of the handle includes a longitudinal axis perpendicular to the arm support.

6. The hand rehabilitation device as claimed in claim 1, wherein the handgrip of the handle includes a finger retaining member.

7. The hand rehabilitation device as claimed in claim 1, wherein the housing includes an opening, with wherein the second output end extends out of the housing through the opening and is connected to the extension of the handle.

8. The hand rehabilitation device as claimed in claim 1, wherein the auxiliary positioning member is parallel to a longitudinal axis of the handgrip.

9. The hand rehabilitation device as claimed in claim 1, further comprising: a forearm positioning member mounted to the arm support, and wherein the forearm positioning member is aligned with the handgrip of the handle.

10. The hand rehabilitation device as claimed in claim 1, wherein the arm support is inclined relative to the base.

11. The hand rehabilitation device as claimed in claim 1, wherein the second actuator is mounted to an engagement member, and wherein the first output end of the first actuator extends through the engagement member and is connected to the arm support.

12. The hand rehabilitation device as claimed in claim 1, wherein the first actuator is a motor.

13. The hand rehabilitation device as claimed in claim 1, wherein the second actuator is an electric cylinder, a hydraulic cylinder, a pneumatic cylinder, or rack gears.

14. The hand rehabilitation device as claimed in claim 1, further comprising: an elbow support mounted to the base, wherein the elbow support includes first and second rods and a support, wherein the first rod is mounted to the base, wherein an end of the second rod is pivotably mounted to the first rod, wherein the support is pivotably mounted to another end of the second rod, and wherein the support is adapted to support an elbow of a user of the hand rehabilitation device.

15. The hand rehabilitation device as claimed in claim 1, further comprising: a fixing device, wherein the fixing device includes first and second fixing boards, wherein a holding space is defined between the first and second fixing boards, wherein the first fixing board includes at least one sliding groove, wherein the base includes a bottom having a plurality of fixing holes facing the at least one sliding groove, and wherein the second fixing board includes a plurality of adjusting members.

* * * * *